United States Patent [19]

Rozmus et al.

[11] Patent Number: 4,478,788

[45] Date of Patent: Oct. 23, 1984

[54] METHOD OF SEALING A CONTAINER

[75] Inventors: Walter J. Rozmus, Traverse City; Jerry L. Dietrich, Williamsburg, both of Mich.

[73] Assignee: Kelsey-Hayes Company, Romulus, Mich.

[21] Appl. No.: 399,932

[22] Filed: Jul. 19, 1982

[51] Int. Cl.[3] ..... B22F 3/14

[52] U.S. Cl. ..... 419/48; 220/256; 220/364

[58] Field of Search ..... 220/364, 256; 419/48

[56] References Cited

U.S. PATENT DOCUMENTS

| | | | |
|---|---|---|---|
| 660,051 | 10/1900 | Croft | 220/364 |
| 3,489,266 | 1/1970 | Miller | 220/364 |
| 4,142,888 | 3/1979 | Rozmus | 419/48 |
| 4,258,739 | 3/1981 | Blankenship | 220/364 |
| 4,263,381 | 4/1981 | McEntire et al. | 429/193 |
| 4,329,175 | 5/1982 | Turner | 419/6 |
| 4,384,655 | 5/1983 | Kendall | 220/256 |

*Primary Examiner*—Edward A. Miller
*Attorney, Agent, or Firm*—Harold W. Milton, Jr.

[57] ABSTRACT

A sealed container (10) of metal material is filled with powdered metal through a fill passageway (14) and sealed with a steel ball (24) forced into the fill passageway (14) of the container (10) while the container (10) is under a vacuum environment. Thereafter, a second cylindrical sealing plug (32) is forced into the fill passageway (14) to engage the first spherical sealing plug (24) and has a gas passageway (34) therein for allowing the escape of gases between the two plugs as the second plug (34) is forced into the fill passageway (14). The second cylindrical sealing plug is then welded to the container (10) about the upper periphery thereof and the gas hole (34) is sealed by welding so that the cavity (12) remains under a vacuum during the hot consolidating process wherein the container (10) is heated and subjected to pressure which is hydrostatically transmitted by the container to the powder within the cavity (12).

9 Claims, 3 Drawing Figures

METHOD OF SEALING A CONTAINER

TECHNICAL FIELD

This invention relates to the filling and sealing of a container. The invention was specifically developed for and has found utility in the filling of a cavity in a container with powdered metal in a vacuum environment. After the container is filled and sealed, it is subjected to heat and pressure for compacting and densifying the powdered metal within the container.

BACKGROUND ART

There are systems known to the prior art which function to apply a vacuum to a container before filling the container with powdered metal and which seal the container before the container is removed from the assembly to prevent the ingress of gases into the cavity filled with the powdered metal. In accordance with the prior art procedures, a thick-walled container having a cavity therein and of the type disclosed and claimed in U.S. Pat. No. 4,142,888 in the name of the inventor named herein and assigned to the assignee of the subject invention is filled with powder through a fill passageway while under a vacuum. The filling and sealing of the container, while under a vacuum, may be conducted in accordance with the teachings of co-pending application Ser. No. 364,789 filed Apr. 2, 1982 in the name of Wendell E. Parker and assigned to the assignee of the subject application wherein a spherical ball is inserted or forced into the fill passageway after the cavity in the container has been filled with powdered metal while remaining under a vacuum environment. Thereafter, the container, with the ball seal in place, is removed from the filling apparatus and heated and placed in a press for compaction and densification of the powder within the cavity of the container. In many instances, the ball seal is of a different material than the container and, therefore, has a different coefficient of thermal expansion so that upon heating of the assembly prior to compaction, there may result leakage between the ball and the container because of the difference in thermal expansion. Thus, the ball seal may provide a very effective seal at the temperatures utilized for filling the container but may leak at higher temperatures to which the container is subjected.

SUMMARY OF THE INVENTION AND ADVANTAGES

The subject invention relates to a container and method of filling the container which has a cavity therein with a fill passageway extending from the exterior of the container to the cavity by filling the cavity in the container and inserting a first sealing plug having an exterior generally conforming to the interior of the fill passageway into the fill passageway to seal the fill passageway. The invention is characterized by inserting a second sealing plug into the fill passageway to seal the fill passageway.

In accordance with the subject invention, a container may be filled with material and a first sealing plug inserted into the fill passageway to effect a seal of the container and the vacuum therein and thereafter a second seal plug inserted into the fill passageway so that the combination of the two seals cover the total spectrum of the environments to which the container will be subjected to maintain the seal of the container in all of those environments.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

A container being filled and sealed in accordance with the subject invention is generally indicated at 10. The container 10 has a cavity 12 therein for receiving and being filled with a material such as powdered metal. The container 10 also includes a fill passageway 14 extending from the exterior of the container 10 to the cavity 12 thereof. As will be appreciated, the container and the cavity 12 therein may be of various different shapes and configurations depending upon the desired shape or configuration of the final compacted product.

Figure 1:
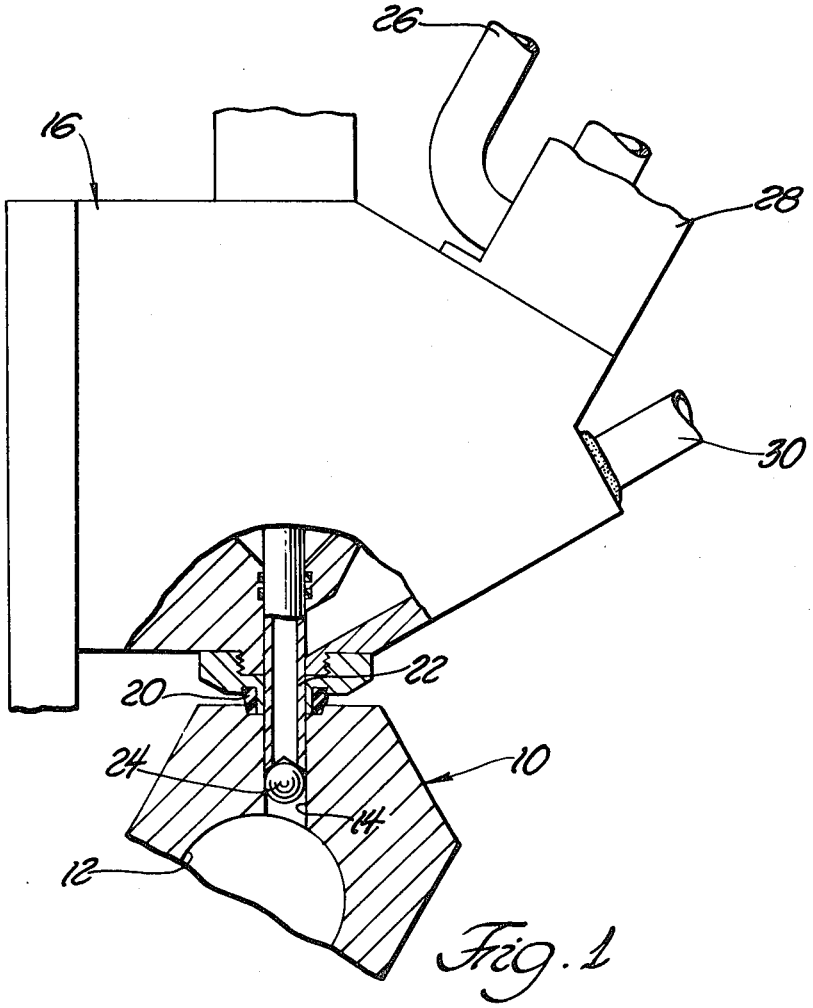
FIG. 1 is a fragmentary side elevational view partially broken away and in cross section of a container being filled and sealed in accordance with the subject invention.

A fill and seal assembly is generally indicated at 16 in FIG. 1 for filling and sealing the container 10. The container 10 includes a dished recess 18 extending about and radially of the outward extremity of the fill passageway 14. The fill and seal assembly 16 includes a seal 20 which engages the recess 18 as the container 10 is held in position thereagainst by an appropriate assembly (not shown). Any appropriate clamping apparatus may be utilized for maintaining the container in position against the seal 20.

The assembly 16 includes a snout member 22 which is utilized for delivering material for filling the cavity 12 and also inserting a first sealing plug 24 into the fill passageway 14. The assembly 10 may be of the type disclosed and claimed in the aforementioned application Ser. No. 364,789 filed Apr. 2, 1982, the disclosure of which is incorporated herein by reference to the extent necessary for disclosing an assembly suitable for filling and sealing the container 10. It will be appreciated, however, that various assemblies may be utilized under the umbrella of the subject invention for filling and sealing the container 10.

By way of example, the container 10 may be made of a metal, such as copper, whereas the first sealing plug 24 may be made of a harder material, such as steel. The first sealing plug 24 as disclosed, is a spherical ball having an exterior diameter generally conforming to the interior of the fill passageway 14. More specifically, the fill passageway 14 is circular in cross section and the ball 24 has a larger diameter than the diameter than the fill passageway 14. The snout member 22 is inserted into the container 10 for filling the cavity 12 and is thereafter retracted at which time a spherical ball is fed from a tube 26 and through a cartridge 28 into the top of the fill passage 14. Thereafter, the snout member 22 is moved downward from the retracted position to engage the spherical ball 24 for forcing the spherical ball 24 into wedging engagement with the fill passage 14 to seal the fill passage 14. The conduit 30 provides a source of vacuum for maintaining the system under a vacuum environment. Since the steel ball 24 is slightly larger in diameter than the fill passage 24, it may force or move in a plastic-flow fashion the softer material of the container 10 to effect the proper seal, whereupon the passageway 14 above the spherical ball will become slightly larger in diameter than the diameter of the ball 24. The container 10 is filled with material by the snout member 22 and the spherical sealing plug 24 is placed in position while the container 10 is held in position, as illustrated in FIG. 1, against the assembly 16 so that the vacuum is maintained until the sealing plug 24 is in position to seal the container 10.

After the container 10 is filled and sealed by the spherical ball 24, as shown in FIG. 1, it may be removed from the assembly 16 and further sealed by inserting a second sealing plug 32 into the fill passageway 14 above the spherical ball 24 to further seal the fill passageway 14. The second sealing plug 32 is preferably of the same material of which the container 10 is made and is of a cylindrical configuration having a diameter larger than the diameter of the fill passageway 14 above the spherical plug 24. The second seal plug 32 may be forced into the fill passageway 14 by any appropriate means as by hammering or a clamping assembly.

The second cylindrical sealing plug 32 includes a gas hole or passage 34 therein and extending therethrough from one end to the other. The gas passage 34 allows gas trapped between the first spherical plug 24 and the second cylindrical plug 32 to escape as the second plug 32 is inserted and forced into the fill passageway 14. The second plug 32 is forced into the passageway until it makes contact with the first spherical plug 24.

After the second sealing plug 32 is inserted into the fill passageway 14 by being forced therein to provide a seal between the exterior surfaces of the plug 32 and the interior surface of the fill passageway 14 and the container 10, the plug 32 is bonded to the container 10 and the gas hole 34 is closed. Specifically, the container 10 and the upper periphery of the second plug 32 are welded together at the juncture between the outer periphery of the plug 32 and the inner surface of the fill passageway 14 of the container 10, the weld being shown at 36. In addition, the top of the gas hole is closed by a weld 38. The ball 24 cannot be welded to the container 10 because it would leak during the welding, however, insufficient heat is transferred to the ball 24 during welding of the cylinder 32 to cause leakage past the ball 24.

Figure 2:
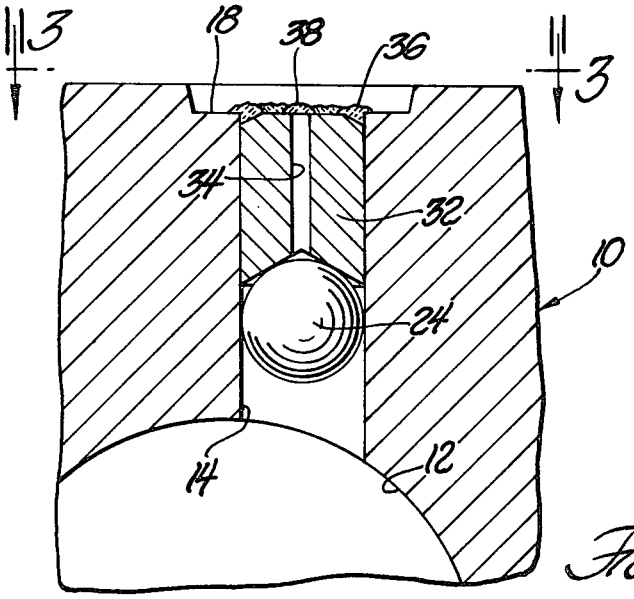
FIG. 2 is an enlarged fragmentary cross-sectional view showing the filled and sealed container of the subject invention.
Figure 3:
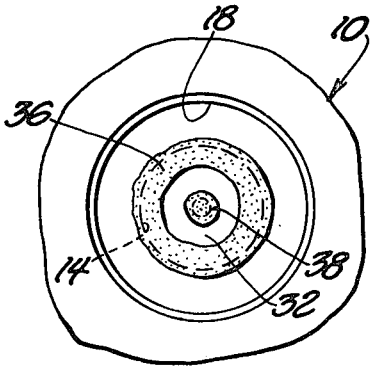
FIG. 3 is a fragmentary view taken substantially along lines 3—3 of FIG. 2.

The container 10 is utilized in the hot consolidation of powdered material to form a densified compact by encapsulating the powdered material in the cavity 12 of the pressure-transmitting container 10. After the container 10 is sealed by the sealing plugs 24 and 32, as shown in FIG. 2, it is heated to a temperature sufficient for consolidation and densification of the material within the cavity 12. External pressure is applied to the entire exterior of the heated container 10 to cause a predetermined densification of the encapsulated material in the cavity 12 by hydrostatic pressure applied by the container 10 in response to the container 10 being substantially fully dense and incompressible and capable of fluidic flow or plastic flow at least just prior to the predetermined densification. This may be accomplished by placing the container 10 within a press, as disclosed in the aforementioned U.S. Pat. No. 4,142,888. During this process the container 10 remains completely sealed against gas ingress into the cavity 12 no matter what temperature or pressure environment the container is subjected to because of the combination of the two sealing plugs 24 and 32. In other words, the first sealing plug 24 is forced into position to effect a seal in the container while the container is under a vacuum environment and thereafter the second sealing plug 32 may be inserted and welded to the container or otherwise bonded thereto to perfect a seal which will prevent leakage under the various environmental conditions to which the container 10 will then be subjected in the hot consolidating process.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A method of filling and sealing a container (10) having a cavity (12) therein with a fill passageway (14) extending from the exterior of the container (10) to the cavity (12) thereof by filling the cavity (12) in the container (10) and inserting a first sealing plug (24) having an exterior generally conforming to the interior of said fill passageway (14) into the fill passageway (14) to seal the fill passageway (14), characterized by inserting a second sealing plug (32) with a gas hole (34) therein to allow gas between the first (24) and second (32) plugs to escape as the second plug (32) is inserted into the fill passageway (14) to seal the fill passageway (14).

2. A method as set forth in claim 1 further characterized by inserting a first sealing plug (24) of a larger dimension than the fill passageway (14) and of a harder material than the container (10).

3. A method as set forth in claim 2 further characterized by bonding the second plug (32) to the container (10) and closing the gas hole (34) therein.

4. A method as set forth in claim 3 further characterized by the container (10) and first (24) and second (32) plugs being of metal and welding (36) the second plug (32) to the container (10) and welding (38) the gas hole (34) closed.

5. A method as set forth in claim 3 wherein the fill passageway (14) is circular in cross section and further characterized by inserting a first plug (24) of a spherical configuration having a diameter larger than the fill passageway (14).

6. A method as set forth in claim 5 further characterized by inserting a second plug (32) of a cylindrical configuration and of a larger diameter than the fill passageway (14).

7. A method as set forth in claim 6 wherein the cavity (12) of the container (10) is filled with material under a vacuum and inserting the first plug (24) while the cavity (12) is under a vacuum to maintain the vacuum therein.

8. A method of hot consolidating material to form a densified compact wherein a quantity of such material is encapsulated in a cavity (12) in a pressure-transmitting container (10) which is heated and to which external pressure is applied to the entire exterior of the heated container (10) to cause a predetermined densification of the encapsulated material of hydrostatic pressure applied by the container (10) in response to the container (10) being substantially fully dense and incompressible and capable of fluidic flow at least just prior to the predetermined densification, characterized by filling the cavity (12) of the container (10) through a fill passageway (14) of circular cross section, inserting a spherical plug (24) having a larger diameter than the fill passageway (14) into the fill passageway (14), inserting a cylindrical plug (32) having a gas hole (34) therethrough and larger diameter than the fill passageway (14) into the fill passageway (14) and into engagement with the spherical plug (24) as gas therebetween escapes through the gas hole (34), welding (36) the cylindrical plug (32) to the container (10) about the periphery of said fill passageway (14) and welding (38) the gas hole (34) closed before heating and subjecting the container (10) to the pressure for densification of the material encapsulated in the container (10).

9. A method as set forth in claim 8 wherein the container (10) and the spherical (24) and cylindrical (32) plugs are of metal and further characterized by inserting the spherical plug (24) of a harder metal than the container (10) metal and inserting the cylindrical plug (32) of the same metal as the container (10).

* * * * *